US009457455B2

(12) United States Patent
Chern

(10) Patent No.: US 9,457,455 B2
(45) Date of Patent: Oct. 4, 2016

(54) ADJUSTABLE RATCHET WRENCH

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 250 days.

(21) Appl. No.: 14/106,720

(22) Filed: Dec. 14, 2013

(65) Prior Publication Data

US 2015/0165599 A1 Jun. 18, 2015

(51) Int. Cl.
*B25B 13/46* (2006.01)
*B25B 13/16* (2006.01)

(52) U.S. Cl.
CPC ..... *B25B 13/16* (2013.01); *B25B 13/462* (2013.01)

(58) Field of Classification Search
CPC ..... B25B 13/16; B25B 13/46; B25B 13/462; B25B 13/463
USPC ..... 81/60, 166, 170, 179
See application file for complete search history.

(56) References Cited

U.S. PATENT DOCUMENTS 12,935 A * 5/1855 Coburn ..... B25B 13/16 81/166
5,860,336 A * 1/1999 Chen ..... B25B 13/12 81/170
6,029,548 A * 2/2000 Hsieh ..... B25B 13/16 81/166
D718,996 S * 12/2014 Robinson ..... D8/22
2003/0121376 A1* 7/2003 Huang ..... B25B 13/46 81/166

* cited by examiner

*Primary Examiner* — Hadi Shakeri
(74) *Attorney, Agent, or Firm* — Pro-TECHTOR International Services; Ian Oglesby

(57) ABSTRACT

An adjustable ratchet wrench includes a head with a handle. The head has a space defined therein. A first pawl is located in the head and has a first engaging portion which protrudes through a recess in the inside of the space. A hollow slide is movably located in the space and has a passage defined axially therethrough. An index member extends from the top side of the slide. A second pawl is located in the first end of the slide and has a second engaging portion facing the space. A threaded rod extends through the passage of the slide and outer threads. The slide has an insertion member inserted therein and the insertion member has an engaging part which is engaged with the outer threads. By rotating the threaded rod, the slide with the second pawl move into the space to clamp objects of different sizes.

4 Claims, 8 Drawing Sheets

ADJUSTABLE RATCHET WRENCH

BACKGROUND OF THE INVENTION

1. Fields of the Invention

The present invention relates to a ratchet wrench, and more particularly, to a ratchet wrench which quickly clamps the object.

2. Descriptions of Related Art

There are may different types of conventional ratchet wrenches which are designed to tighten or loose an object. However, the objects to be tightened or loosened have different sizes and the clamp distance of the conventional ratchet wrenches cannot be quickly adjusted.

The present invention intends to provide a ratchet wrench wherein the clamp distance can be adjusted to as to improve the shortcomings mentioned above.

SUMMARY OF THE INVENTION

The present invention relates to an adjustable ratchet wrench and comprise a head and a handle is connected to a connection end of the head. A space is defined in the head and a recess is defined in the inside of the first inner end of the space. A first reception hole is defined in the inside of the second inner end of the space.

A first pawl is located in the space and has a first engaging portion. A first pin extends through a first hole in the first pawl to pivotably position the first pawl in the head. The first engaging portion protrudes through the recess in the inside of the first inner end of the space and is located in the space. A positioning unit is located between the first pawl and the inside of the recess in the head so as to bias the first pawl toward the space.

A hollow slide is located in the space and has a curved end defined in the first end thereof. A passage is defined axially through the slide and communicates through the first end and the second end of the slide. An insertion hole is defined transversely in the slide and communicates with the passage. An engaging member is inserted into the insertion hole and has an engaging part extending therefrom. An index member extends from the top side of the second end of the slide.

A second pawl is pivotably located in the passage in the first end of the slide by extending a second pin through a second hole defined in the second pawl. The second pawl has a second engaging portion which protrudes from the first end of the slide and faces the space. Another positioning unit is located between an inside of the first end of the slide and the second pawl to bias the second pawl toward the space.

A threaded rod extends through the passage of the slide. The threaded rod has outer threads and an engaging protrusion which axially protrudes from an end of the threaded rod. The engaging part of the engaging member is engaged with the outer threads. The engaging protrusion is connected with a knob which is accessible from an outside of the head.

A cover is fixed to the top of the head and has a slot defined therethrough. The index member extends through the slot. Multiple marks are marked on the cover along one side of the slot.

Preferably, each of the positioning units comprises a spring and a positioning member.

Preferably, the engaging protrusion of the threaded rod and the knob are integrally formed with each other.

Preferably, the engaging protrusion is a polygonal rod and the knob has a polygonal second reception hole with which the engaging protrusion is engaged.

The primary object of the present invention is to provide an adjustable ratchet wrench which is able to easily clamp objects of different sizes.

Another object of the present invention is to provide an adjustable ratchet wrench wherein the user is acknowledged the size of the object that is clamped by the wrench.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
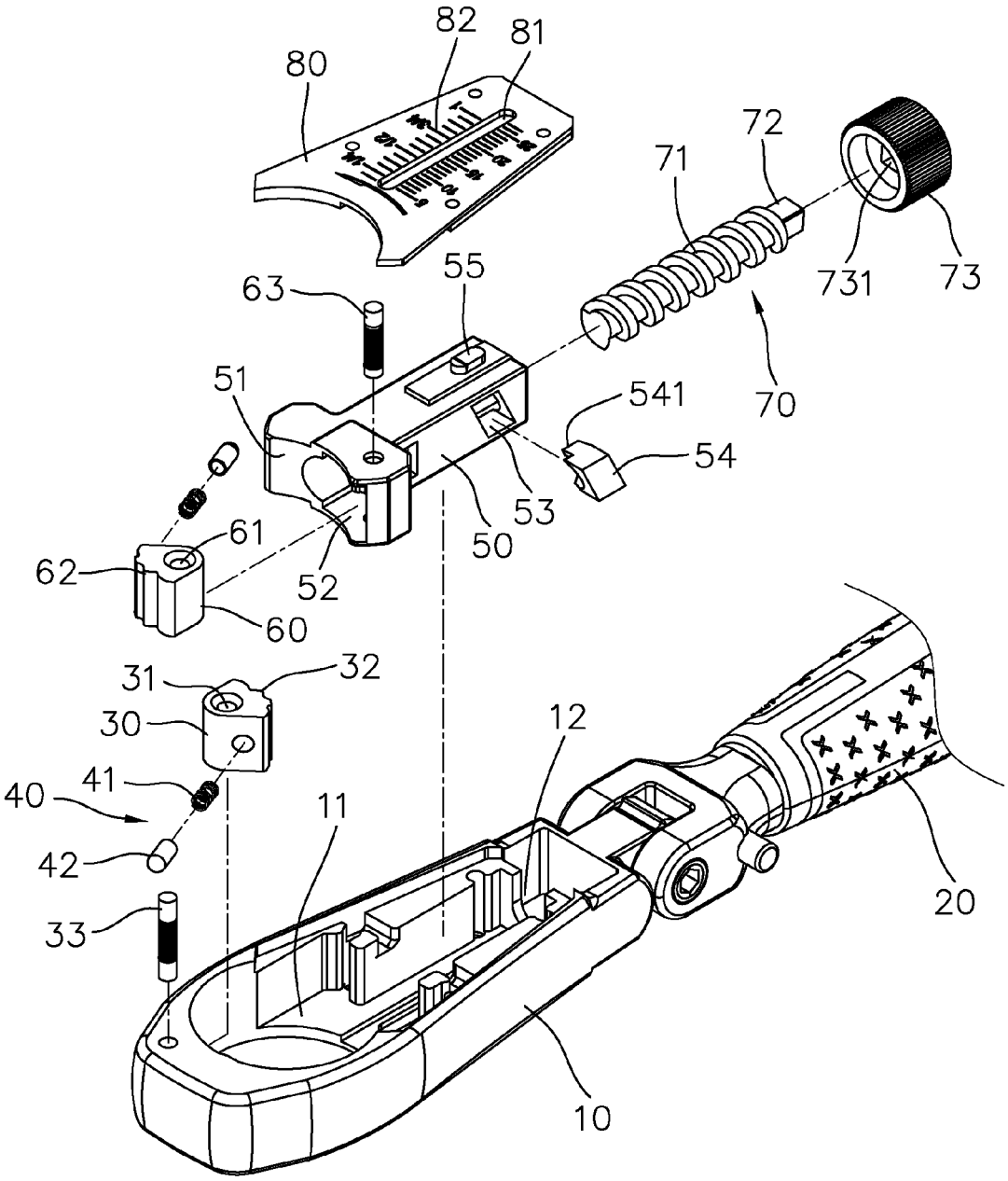
FIG. 1 is an exploded view of the adjustable ratchet wrench of the present invention.
Figure 2:
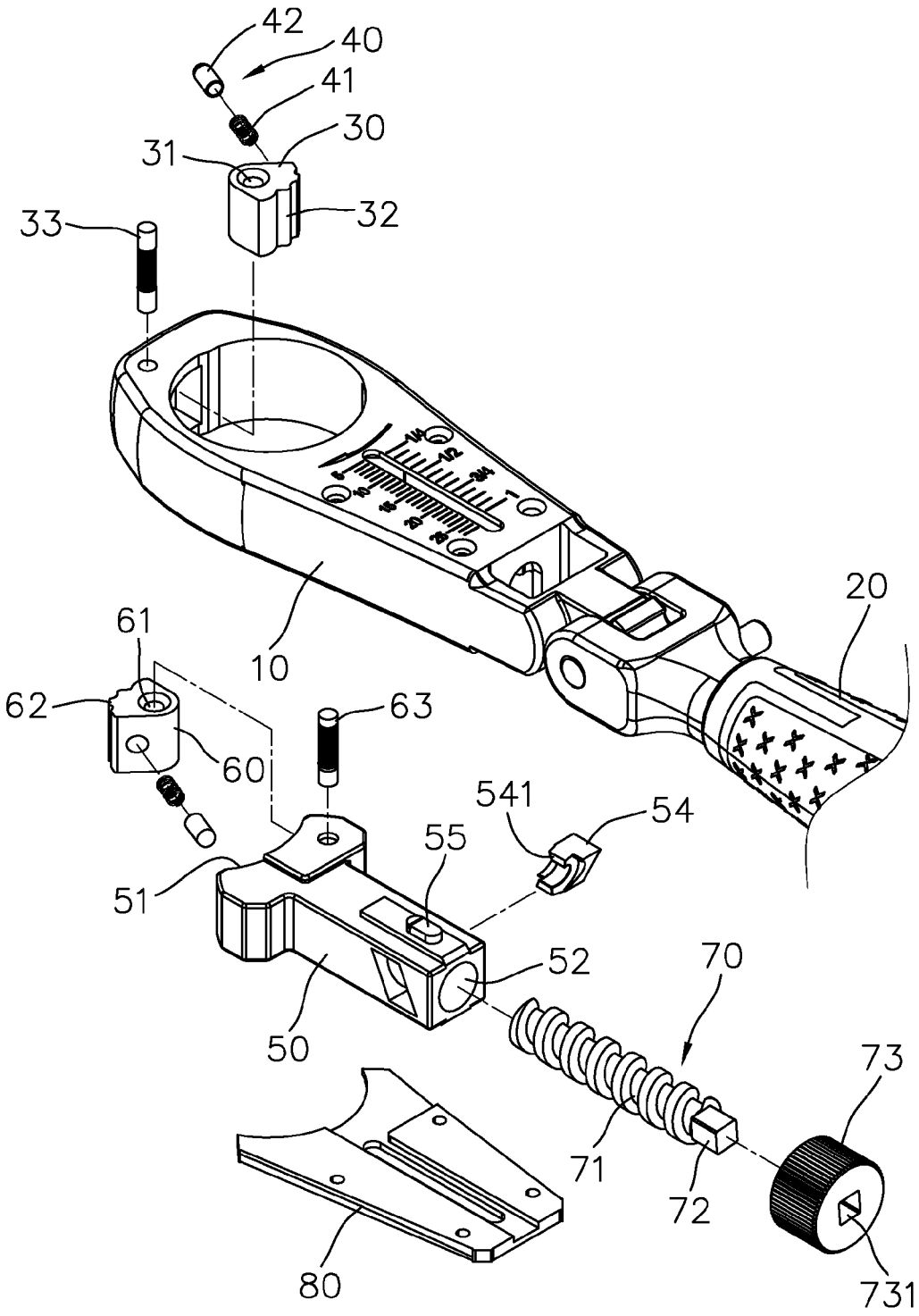
FIG. 2 is an exploded view of the adjustable ratchet wrench of the present invention from another angle.
Figure 3:
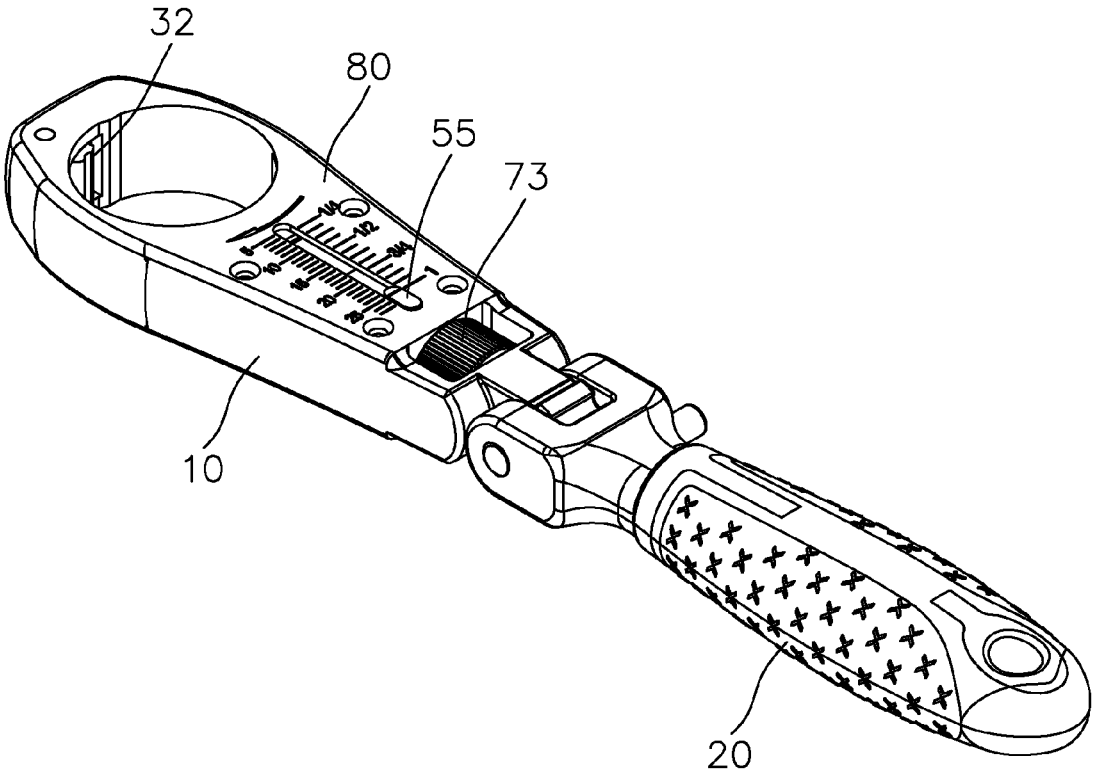
FIG. 3 is a perspective view to show the adjustable ratchet wrench of the present invention.
Figure 4:
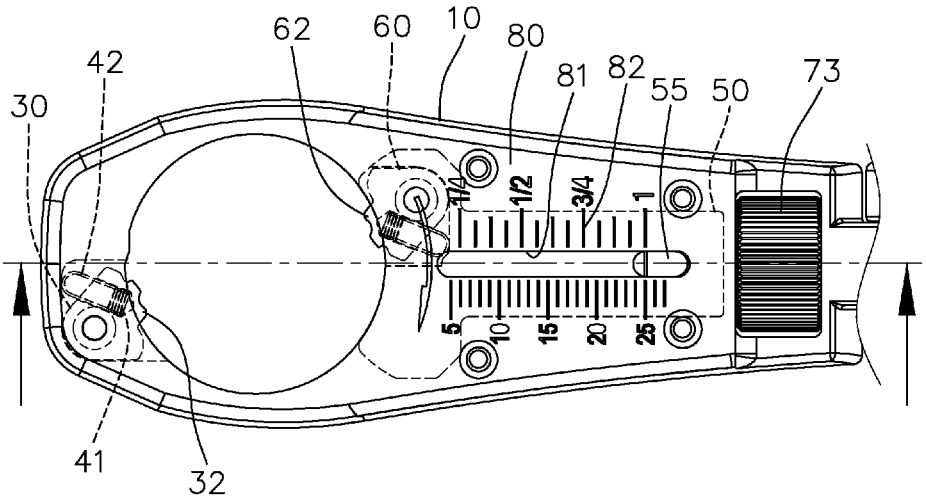
FIG. 4 is a top view of the adjustable ratchet wrench of the present invention.
Figure 5:
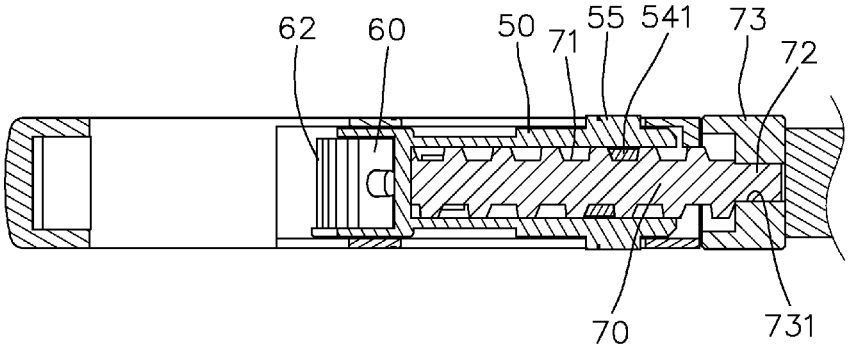
FIG. 5 is a cross sectional view taken along line 4-4 in FIG. 4.
Figure 6:
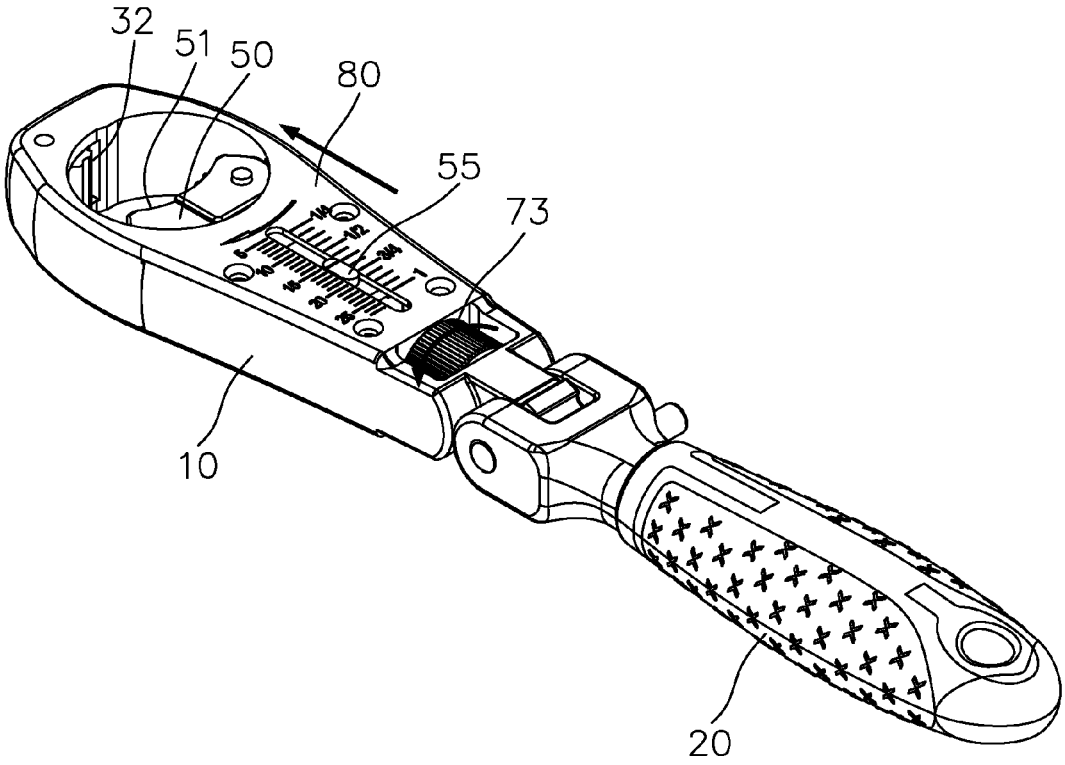
FIG. 6 is a perspective view to show that the slide of the adjustable ratchet wrench of the present invention is moved toward the first pawl.
Figure 7:
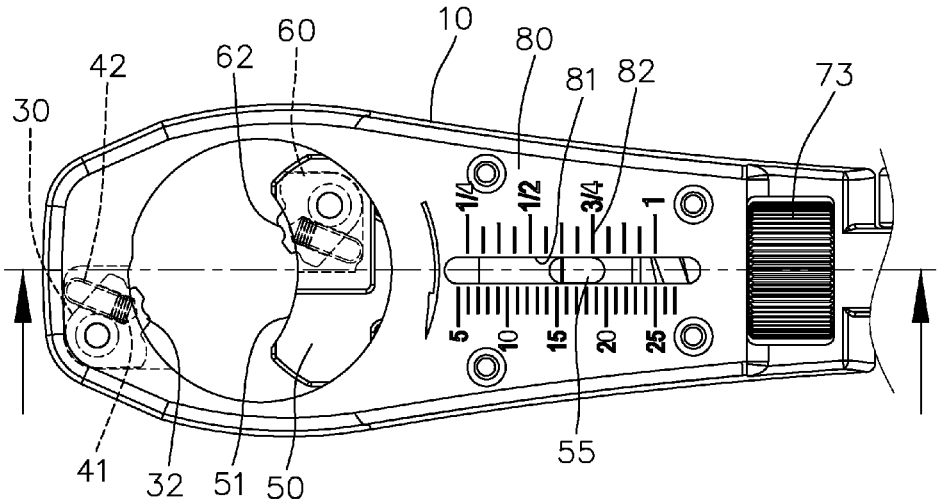
FIG. 7 is a top view to show that the slide of the adjustable ratchet wrench of the present invention is moved toward the first pawl.
Figure 8:
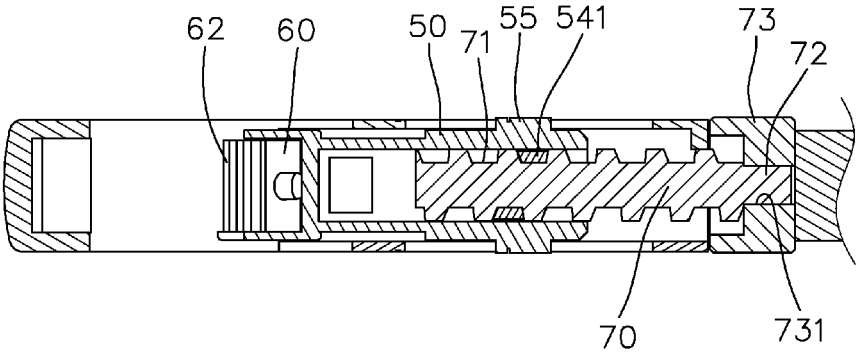
FIG. 8 is a cross sectional view taken along line 7-7 in FIG. 7.

Referring to FIGS. 1 to 12, the adjustable ratchet wrench of the present invention comprises a head 10 and a handle 20 is connected to the connection end of the head 10. A space 11 is defined in the head 10 and a recess is defined in the inside of the first inner end of the space 11. A first reception hole 12 is defined in the inside of the second inner end of the space 11.

A first pawl 30 is located in the head 10 and has a first engaging portion 32 which includes two teeth in this embodiment. A first pin 33 extends through a first hole 31 in the first pawl 30 to pivotably position the first pawl 30 in the head 10. The first engaging portion 32 protrudes through the recess in the inside of the first inner end of the space 11 and is located in the space 11. A positioning unit 40 is located between the first pawl 30 and the inside of the recess in the head 10 so as to bias the first pawl 30 toward the space 11.

A hollow slide 50 is located in the space 11 and has a curved end 51 defined in the first end thereof. A passage 52 is defined axially through the slide 50 and communicates through the first end and the second end of the slide 50. An insertion hole 53 is defined transversely in the slide 50 and communicating with the passage 52. An engaging member 54 is inserted into the insertion hole 53 and has an engaging part 54 extending therefrom. An index member 55 extends from the top side of the second end of the slide 50.

A second pawl 60 is pivotably located in the passage 52 in the first end of the slide 50 by extending a second pin 63 through a second hole 61 defined in the second pawl 60. The second pawl 60 has a second engaging portion 62 which protrudes from the first end of the slide 50 and faces the space 11. The second engaging portion 62 includes two teeth in the embodiment. Another positioning unit 40 is located between the inside of the first end of the slide 50 and the second pawl 60 to bias the second pawl 60 toward the space 11. Each of the positioning units 40 comprises a spring 41 and a positioning member 42.

A threaded rod 70 extends through the passage 52 of the slide 50, and the threaded rod 70 has outer threads 71 and an engaging protrusion 72 which axially protrudes from an end of the threaded rod 70. The engaging part 541 of the engaging member 54 is engaged with the outer threads 71. The engaging protrusion 72 is connected with a knob 73 which is accessible from an outside of the head 10. The engaging protrusion 72 is a polygonal rod and the knob 73 has a polygonal second reception hole 731 with which the engaging protrusion 72 is engaged. The engaging protrusion 72 of the threaded rod 70 and the knob 73 may also be integrally formed with each other.

A cover 80 is fixed to the top of the head 10 and has a slot 81 defined therethrough. The index member 55 extends through the slot 81. Multiple marks 82 are marked on the cover 80 along one side of the slot 81.

Figure 9:
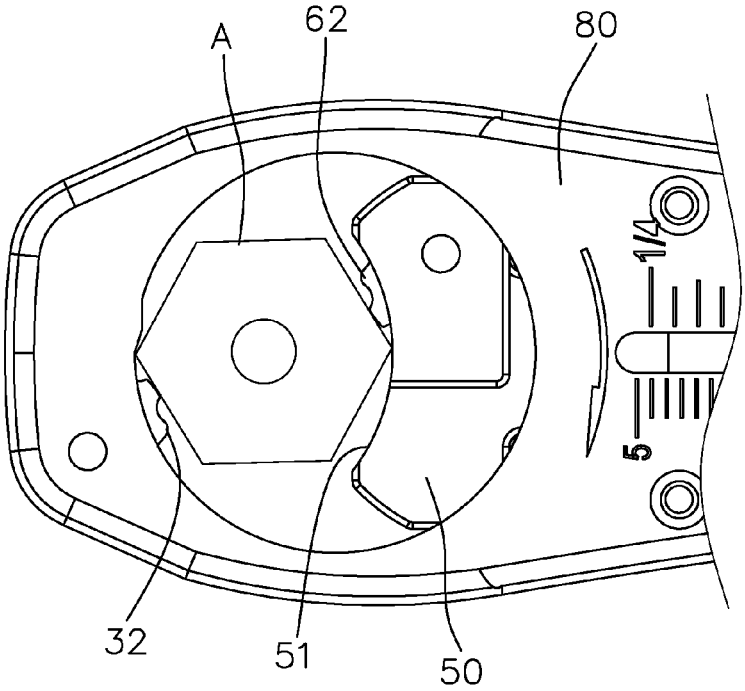
FIGS. 9 and 10 show that the adjustable ratchet wrench of the present invention clamps a larger object.
Figure 11:
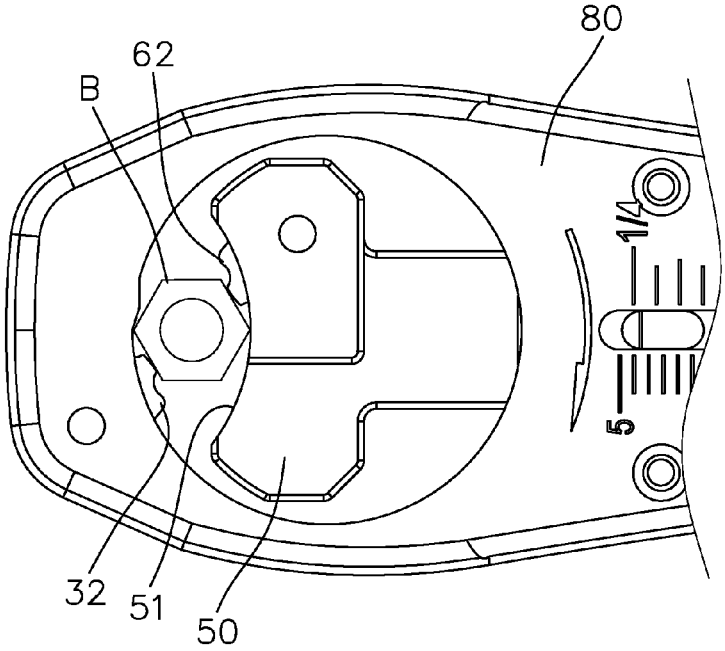
FIGS. 11 and 12 show that the adjustable ratchet wrench of the present invention clamps a smaller object.

When in use, the object to be tightened or loosened is located in the space 11 of the bead 10 and the user rotates the knob 73 so that the threaded rod 70 is rotated. Because the engaging part 541 of the engaging member 54 of the slide 50 contacts the outer threads 71 of the threaded rod 70, so that the slide 50 moves toward the object until the curved end 51 of the slide 50 contacts the object. The first engaging portion 32 of the first pawl 30 and the second engaging portion 62 of the second pawl 60, and the curved end 51 of the slide 50 together clamp the object as shown in FIGS. 9 and 11 to as to tighten or loosen the object.

Figure 10:
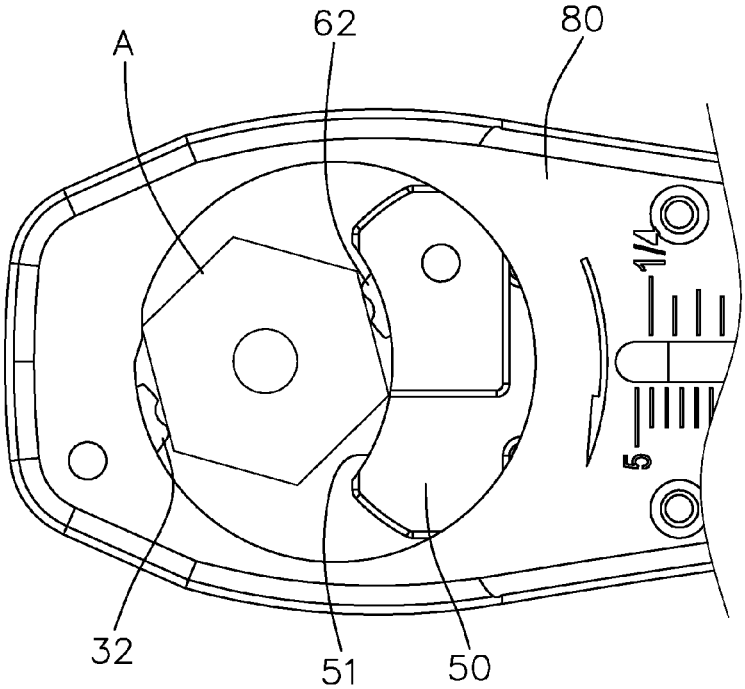
Figure 12:
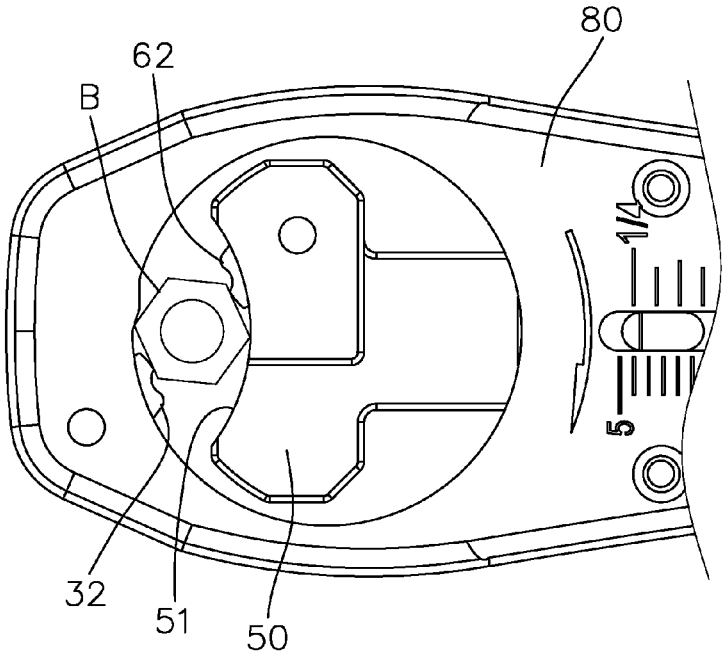

It is noted that the object to be clamped is clamped at four points which are the first engaging portion 32 of the first pawl 30, the second engaging portion 62 of the second pawl 60, the curved end 51 of the slide 50 and the inside of the space 11 in the head 10. Therefore, when clamping a larger object "A" or a smaller object "B" as shown in FIGS. 9 and 11, the object is firmly clamped and is not tilt. As shown in FIGS. 10 and 12, when rotating the object, the first engaging portion 32 of the first pawl 30 and the second engaging portion 62 of the second pawl 60 can firmly clamp the object so as to rotate the object in vertical direction or horizontal direction.

Because there are marks 82 on the top of the cover 80, the user is acknowledged the size of the object by checking the mark 82 in alignment with the index member 55 that is moved along the slot 81.

The outer threads 71 are designed such that when the threaded rod 70 is rotated one revolution, the slide 50 moves a significant distance so as to quickly move the slide 50 to contact the object. The slide 50 moves 5 to 10 times faster than that of the conventional wrenches.

The marks 82 can also be marked on the bottom of the cover 80 so that the user can easily check the marks 82 from different positions.

While we have shown and described the embodiment in accordance with the present invention, it should be clear to those skilled in the art that further embodiments may be made without departing from the scope of the present invention.

What is claimed is:

1. An adjustable ratchet wrench comprising:

a head, a handle connected to a connection end of the head, a space defined in the head, a recess defined in the inside of a first inner end of the space, a first reception hole defined in an inside of a second inner end of the space;

a first pawl located in the space and having a first engaging portion, a first pin extending through a first hole in the first pawl to pivotably position the first pawl in the head, the first engaging portion protruding through the recess in the inside of the first inner end of the space and located in the space, a positioning unit located between the first pawl and an inside of the recess in the head so as to bias the first pawl toward the space;

a hollow slide located in the space and having a curved end defined in a first end thereof, a passage defined axially through the slide and communicating through the first end and a second end of the slide, an insertion hole defined transversely in the slide and communicating with the passage, an engaging member inserted into the insertion hole and having an engaging part extending therefrom, an index member extending from a top side of the second end of the slide;

a second pawl pivotably located in the passage in the first end of the slide by extending a second pin through a second hole defined in the second pawl, the second pawl having a second engaging portion which protrudes from the first end of the slide and faces the space, another positioning unit located between an inside of the first end of the slide and the second pawl to bias the second pawl toward the space;

a threaded rod extending through the passage of the slide, the threaded rod having outer threads and an engaging protrusion which axially protrudes from an end of the threaded rod, the engaging part of the engaging member engaged with the outer threads, the engaging protrusion connected with a knob which is accessible from an outside of the head, and a cover fixed to a top of the head and having a slot defined therethrough, the index member extending through the slot, multiple marks being marked on the cover along one side of the slot.

2. The wrench as claimed in claim 1, wherein each of the positioning units comprises a spring and a positioning member.

3. The wrench as claimed in claim 1, wherein the engaging protrusion of the threaded rod and the knob are integrally formed with each other.

4. The wrench as claimed in claim 1, wherein the engaging protrusion is a polygonal rod and the knob has a polygonal second reception hole with which the engaging protrusion is engaged.

* * * * *